US010035060B1

(12) United States Patent
Swyers

(10) Patent No.: US 10,035,060 B1
(45) Date of Patent: Jul. 31, 2018

(54) METHOD AND SYSTEM FOR CONTROLLING AUTO RACES

(76) Inventor: John Swyers, Mansfield, MA (US)

( * ) Notice: Subject to any disclaimer, the term of this patent is extended or adjusted under 35 U.S.C. 154(b) by 1025 days.

(21) Appl. No.: 13/495,438

(22) Filed: Jun. 13, 2012

(51) Int. Cl.
*A63F 9/00* (2006.01)
*A63K 1/00* (2006.01)
*A63F 3/00* (2006.01)

(52) U.S. Cl.
CPC ..... *A63F 3/00082* (2013.01); *A63K 1/00* (2013.01)

(58) Field of Classification Search
CPC ..... A63F 9/14; A63F 9/00; A63F 3/00; A63F 9/24; A63F 3/00082–3/00085; G01C 9/00; G06F 15/48; A63K 1/00; A63K 3/00; A63K 3/02
USPC ..... 463/6, 40, 43, 58, 30, 31, 32, 59, 60; 273/246, 286, 242, 243, 248, 249, 445, 273/440, 236, 277; 700/91–93; 364/436, 364/464; 340/907, 908
See application file for complete search history.

(56) References Cited

U.S. PATENT DOCUMENTS 3,714,649 A * 1/1973 Brouwer et al. ..... 342/44
4,264,076 A 4/1981 Duncan
4,357,017 A * 11/1982 Schneider et al. ..... 273/246
4,449,114 A * 5/1984 Fascenda et al. ..... 340/988
4,670,844 A * 6/1987 Lach et al. ..... 701/117
5,048,841 A 9/1991 Manney et al.
5,114,152 A * 5/1992 Rouse et al. ..... 273/246
5,186,460 A * 2/1993 Fongeallaz et al. ..... 463/6
5,194,843 A * 3/1993 Jones et al. ..... 340/323 R
5,289,389 A * 2/1994 Keller ..... 702/116
5,322,293 A 6/1994 Goyette
5,350,178 A * 9/1994 Hollar ..... 273/246
5,398,941 A * 3/1995 Paulson ..... 273/445
5,435,553 A * 7/1995 Arima et al. ..... 463/6
5,577,913 A * 11/1996 Moncrief et al. ..... 434/69
5,600,185 A * 2/1997 Hamma ..... B60W 10/06 307/10.1
5,696,481 A * 12/1997 Pejas et al. ..... 340/323 R
5,749,582 A * 5/1998 Fritz et al. ..... 273/246
5,804,885 A * 9/1998 Reid ..... 307/10.1
5,810,358 A * 9/1998 Manson ..... 273/251
5,812,049 A * 9/1998 Uzi ..... 340/323 R
5,934,673 A 8/1999 Telarico et al.
6,005,517 A * 12/1999 Friedrichs ..... 342/457
6,050,895 A * 4/2000 Luciano et al. ..... 463/7
6,095,522 A * 8/2000 Spell et al. ..... 273/246
6,166,629 A * 12/2000 Hamma et al. ..... 340/438
6,254,478 B1 * 7/2001 Namanny et al. ..... 463/6
6,293,548 B1 * 9/2001 Swyers et al. ..... 273/236
6,325,721 B1 * 12/2001 Miyamoto et al. ..... 463/40
6,380,911 B1 * 4/2002 Eaton ..... 345/30
6,572,112 B1 * 6/2003 Fischer ..... A63F 3/00082 273/445
6,604,996 B1 * 8/2003 Namanny et al. ..... 463/6
(Continued)

*Primary Examiner* — Melba Bumgarner
*Assistant Examiner* — Laura L Davison
(74) *Attorney, Agent, or Firm* — Salter & Michaelson

(57) ABSTRACT

A method of conducting a racing competition among a plurality of race cars including conducting qualifying trials among the plurality race cars, arranging the race cars in qualifying order arrangement for the start of the race, altering at least one of time, distance or speed parameters of one or more of the plurality of race cars during the race, and determining the winner and order of race finish at the completion of the race based on the parameters.

6 Claims, 1 Drawing Sheet

(56) References Cited

U.S. PATENT DOCUMENTS

| | | | | |
|---|---|---|---|---|
| 6,733,383 | B2 * | 5/2004 | Busse et al. | 463/6 |
| 6,869,078 | B1 * | 3/2005 | Slowinski | 273/445 |
| 6,979,000 | B1 * | 12/2005 | Vahala | 273/246 |
| 7,207,568 | B2 * | 4/2007 | France et al. | 273/445 |
| 7,261,296 | B1 * | 8/2007 | Duncan | 273/246 |
| 7,336,178 | B2 * | 2/2008 | Le | 340/572.1 |
| 7,645,191 | B1 * | 1/2010 | McKeever | 463/6 |
| 7,677,569 | B2 * | 3/2010 | O'Hara | 273/246 |
| 7,731,447 | B1 * | 6/2010 | Dunwoody | A63K 1/00 404/1 |
| 7,896,740 | B2 * | 3/2011 | Asher et al. | 463/26 |
| 7,956,768 | B2 * | 6/2011 | Roberts | G06Q 30/0284 235/378 |
| 8,137,172 | B2 * | 3/2012 | Lydon et al. | 463/9 |
| 8,272,941 | B2 * | 9/2012 | Acres | 463/20 |
| 2004/0222589 | A1 * | 11/2004 | Taylor | 273/246 |
| 2004/0232615 | A1 * | 11/2004 | Thompson et al. | 273/259 |
| 2006/0284372 | A1 | 12/2006 | Matilla et al. | |
| 2010/0038852 | A1 | 2/2010 | Ishihara et al. | |
| 2010/0072702 | A1 | 3/2010 | Fowler | |
| 2010/0127453 | A1 | 5/2010 | Brown | |

* cited by examiner

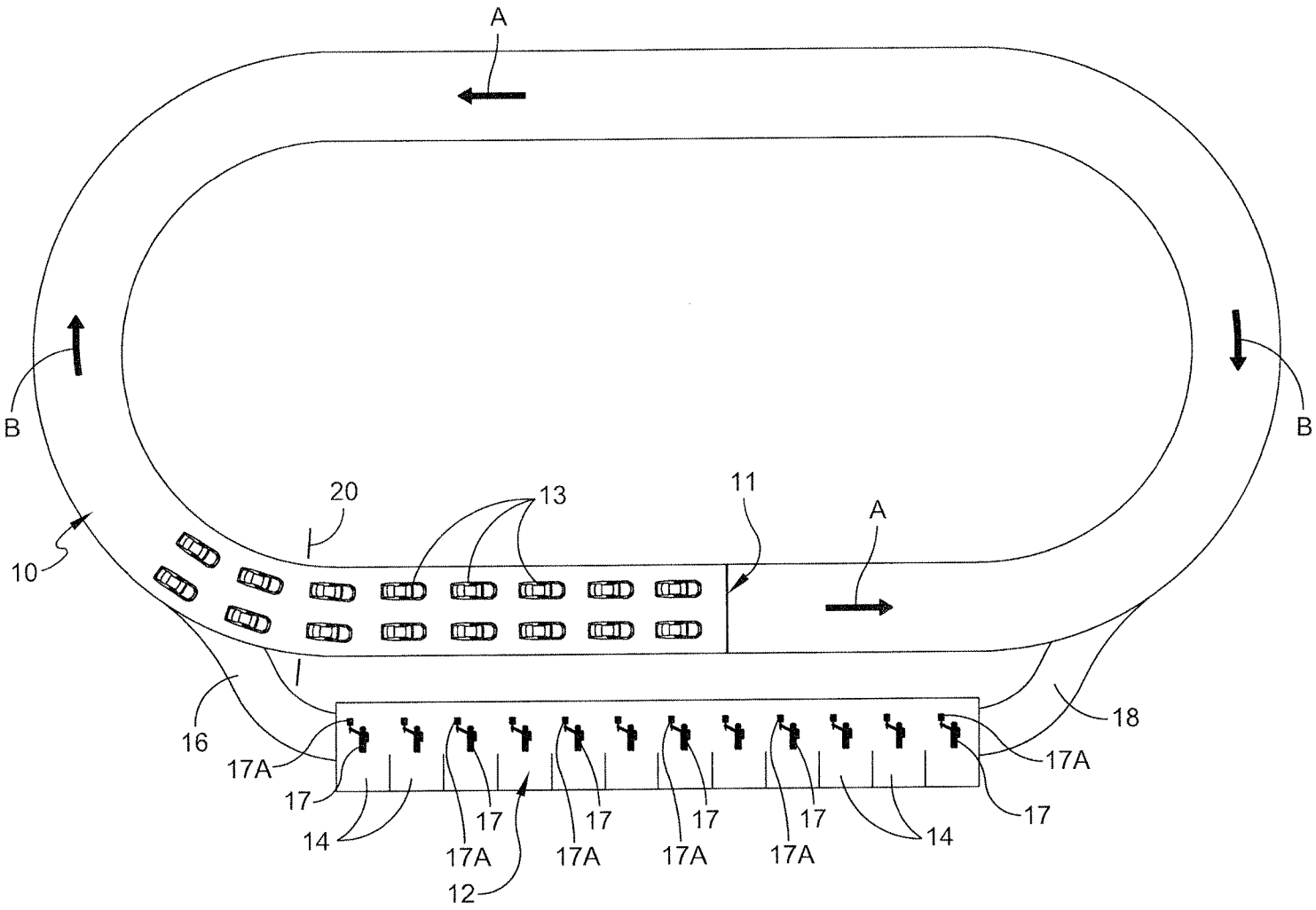
B
A
A
B
10
11
12
13
14
14
16
17
17
17
17
17
17
17
17A
17A
17A
17A
17A
17A
18
20

METHOD AND SYSTEM FOR CONTROLLING AUTO RACES

FIELD OF THE INVENTION

The present invention relates very generally to racing events. More particularly, the present invention pertains to various methods and systems for altering a traditional racing format in order to enhance the experience of the racing fan.

BACKGROUND OF THE INVENTION

Automobile racing is a sport that has developed over the last century. People are naturally competitive and thus there always has been an interest in determining who is the fastest. Races have therefore been organized and conducted to determine which automobile is the fastest. Although races have long been conducted, the format of races has changed very little over the last several years. Races are still generally conducted by having the race participants simultaneously start at a common starting time and then travel over a race course a predetermined fixed distance. The first race participant to cover the required race course distance is traditionally declared the winner and thus the fastest.

Today most aspects in racing are thoroughly specified and highly regulated. Thus the race becomes well defined and the outcomes are somewhat predictable. The biggest variable is the skill of the driver and a measure of luck or good fortune in the pit crew. The "unfair start" condition is particularly unfair now because of the advantage given to the fastest cars. The "unfair start" refers to the fact that, via qualifying times, the fastest cars have the more favorable starting position at the front of the pack of cars.

While determining the fastest competitor in a given race, the traditional and conventional method of conducting races as described above does not always make for the most interesting and captivating race for fans observing the race. Races all too often evolve into a contest where a majority of the contestants chase the front-runner(s). In particular, automotive races oftentimes degenerate into an exhibition of "follow the leader" where the fastest cars, qualifying and starting at the front of the grid, maintain their positions at the front of the race throughout the majority of the race. The race in effect becomes a "follow the leader" event since the cars with the fastest times during qualifying trials begin the race at the forefront of those participating in the race.

Some of the most exciting racing action occurs when cars pass other cars. This is even more exciting when a fast car or driver qualifies for a starting position in the middle or back of the starting grid. This situation most often occurs due to technical, procedural or driver miscalculations during the qualifying trial(s). When this situation does occur, race fans are often treated to some of the most captivating racing because the faster, skilled driver often boldly and aggressively passes other cars in route to the front of the pack. The racing fans are thus treated to a creative display of driving skill and strategy as the misplaced fast car attempts to advance to the front of the pack and challenge the other fast cars.

Thus, one basic problem in modern racing is the unfair start or the unequal start of the race. This derives from the qualification trials and starting grid on the race track. No other sport has a precondition whereby one contestant is noticably held back in comparison to another contestant at the beginning of the contest, and based on the fact that the held back driver is inherently slower. Yet modern motor racing begins by giving the fastest qualifying cars the best position on the track (perhaps in the name of safety).

This starting condition means the fastest cars drive the shortest distance and then they extend their lead by driving unchallenged on the track for the initial laps. These top drivers then can make non-competitive passes on the slowest cars as they go through the rear of the starting grid. All of these elements serve to extend the lead of the fastest. This factor decreases fan excitement and challenges for the fastest drivers.

Some fan excitement comes from watching drivers successfully control their cars at high speeds, especially in the corners, i.e. on turns of the track. All drivers must do that. However, fans are particularly interested in watching drivers attempting passes and successfully passing other drivers. This requires a higher level of driving skill—i.e. maneuvering the car at high speeds around another car that usually does not want to be passed. Fans are aware of this skill and cheer when these drivers are successful. Fans adopt favorites among the drivers because their favorite driver is good at passing and of course winning races. Faster drivers passing slower cars, is not as challenging for the driver or exciting for the fans as passing competitive drivers.

SUMMARY OF THE INVENTION

Accordingly, a goal of this invention is to create a more competitive passing scheme and thereby increase fan interest and excitement at the track and for viewers of the race on viewing screens, live and recorded. In accordance with the present invention the fastest drivers will be challenged as never before. A method and system is provided to enhance the viewing experience of the race fans, particularly by means of more competitive passing particularly among the fastest race cars. The method of the present invention encourages top speeds, and competitive and creative driving.

In accordance with one embodiment of the present invention there is provided a method of conducting a racing competition among a plurality of race cars comprising the steps of: conducting qualifying trials among the plurality race cars; arranging the race cars in qualifying order arrangement for the start of the race; altering at least one of time, distance or speed parameters of one or more of the plurality of race cars during the race; and determining the winner and order of race finish at the completion of the race based on the parameters. One may award some form of credit based on qualification position (QP) to compensate each car that gave up an advantage, and to discourage those cars using the "hold back" strategy.

In accordance with other aspects of the present invention the plurality race cars are delayed a time interval that is equal to their time to cross the starting line subtracted from the time to cross the starting line of the last car to cross the starting line; the plurality race cars are delayed a time interval that is equal to their time to cross the starting line subtracted from the time to cross the starting line of the last predetermined group of cars to cross the starting line; the step of altering includes a pre-arranged addition or subtraction of time or distance or speed capability to the plurality of race cars during the race; the plurality race cars have the speed capabilities modified by changes in at least one of the engine horsepower, the race car weight, the tire characteristics and the aerodynamic drag characteristics; the plurality race cars have the speed capabilities linked by a the mathematical formula:

HP×K1+WT×K2+TR×K3+DR×K4=K5; set K5=1 and K1 through K4 are constants related to each speed characteristic;

Where:

HP=horsepower

WT=weight

TR=tire characteristics

DR=drag characteristics and the plurality race cars have the speed capabilities modified during the race by changes in the tire traction by the pouring or spraying of a liquid on part or all of the race track.

In another version of the present invention there is a method of conducting a racing competition among a plurality race cars, comprising the steps of : conducting qualifying trials among a plurality race cars; arranging the race cars in qualifying order arrangement for the start of the race; at a time after the start of the race, changing the direction of travel for the plurality of race cars during the race; and determining the winner and order of race finish at the completion of the race based upon finish position; and wherein a plurality of qualifying trials for the plurality race cars are conducted in both directions of travel on the track.

In another version of the present invention there is a method of conducting a racing competition among a plurality of race cars that are driven on a race track, and in which there is a pit area where the cars are served, said method comprising the steps of: conducting qualifying trials among the plurality of race cars so as to identify faster and slower cars; arranging the race cars in qualifying order arrangement for the start of the race; the race cars periodically stopping for service at the pit area; establishing a delay period for one or more of the faster cars; applying the delay period in the pit area so as to delay at least one of the faster cars in their exit from the pit area; and determining the winner and order of race finish at the completion of the race based on the finish position awarding some form of credit based upon qualification position (QP).

In accordance with other aspects of the present invention the plurality race cars are delayed a time interval that is equal to their time to cross the starting line subtracted from the time to cross the starting line of the last car to cross the starting line; the plurality race cars are delayed a time interval that is equal to their time to cross the starting line subtracted from the time to cross the starting line of the last predetermined group of cars to cross the starting line; the delay period follows the service period of the race car; alternatively the delay period precedes the service period of the race car; the faster the qualifying speed the greater the delay period; the delay period is successively smaller from the fastest car to progressively less fast cars; a group of more than one of the faster cars has the same delay period; the finish position for the faster cars is the start finish line; alternatively the finish position for the slower cars is determined based upon their starting position on the race track.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which the figure is a schematic diagram of a race track to illustrate the principles of the present invention.

DETAILED DESCRIPTION

The method and system of the present invention can maintain the traditional start with some corrections during the race which allow the race fans and race promoters to make a slower transition to new fairer start procedures. In particular, the present invention pertains to a novel method of conducting a race that encourages improved racing and thus improved race fan excitement. The method and system of the present invention particularly addresses passing opportunities during the race to enhance fan participation. Therefore these features improve excitement for race fans by improving competitive passing. The present invention results from a strict evaluation of the race based on the principles of physics (mechanics) and engineering to create a fair start situation for each driver. The speed of an object (race car) is defined as the distance traveled divided by time to traverse the distance. Therefore, in racing, the invention realizes that one can change any or all of these three elements to alter the race to enhance fan excitement so as to improve passing opportunities, safety considerations, or any other character of the race that creates competitive challenges for the drivers.

More particularly, the following are the race elements that can be considered.

| Element | method of change |
|---|---|
| distance: | add or subtract distance requirements on any or all race cars to correct the unfair start; |
| time: | add or subtract time requirements on any or all race cars to correct the unfair start; |
| speed: | add or subtract speed capabilities on any or all race cars with various means to correct the unfair start; |

The above elements are changed or modified by the race promoters to offer the best excitement for race fans by challenging the skill of the drivers. For example, to correct for the traditional start:

- add distance to the route of faster cars or subtract distance from the slower cars so each car travels the same distance;
- add time corrections to the faster cars or subtract the time correction from the slower cars so that each car is measured by the time to travel from the starting line;
- increase speed capabilities of the slowest cars or subtract this capability from the faster cars;

All or a combination of these elements are used to correct for the traditional start and thereby to increase competitive passing situations during the race. These changes cause an overall increase in race fan excitement. However, race promoters may feel that many modifications to the traditional starting grid method may be too great of a step to take for the fans or the drivers. Therefore, the present invention may be implemented in phases.

First Embodiment

A qualification trial to determine the fastest cars is conducted and the order and speed of the cars is recorded. Before the race, the cars are arranged in a grid on the race track with the fastest car in the front row usually closest to the first turn, second fastest beside or behind the fastest car and so on to the least fastest cars at the end of the grid. A fair start and more competitive passing occur during the race by adding a predetermined time delay during servicing of each car while in the pits. This simulates the effect of all cars starting on the same starting line. This delay equalizes many of the previously mentioned problems with the traditional start of the race and yet still provides the front cars some advantages over the slower cars.

The time delay to be applied for each car in the pit area may be determined in a number of different ways. For example, the time delay may be equal to the time difference between each car as it passes over the starting line and the last car to pass over the starting line, or a certain group of cars (or even a single car) as they pass over the starting line. This affords the race promoter (and drivers) the traditional starting conditions while taking some of the unfairness out of these starting conditions. The time difference can be measured with timing equipment carried in each car as it passes over the starting line or with cameras as the race is started. The time information for each car is transferred to a light or signaling device. A race official 17 with the signaling device 17A stands in front of each car in the pits when it arrives for the pit stop. The driver and pit crew observes the signaling light of the official to determine whether the car can be serviced. The light, or other signaling device, for each car may be illuminated until the car arrives in the proper pit position and the official then starts the time delay. This may be initiated by a change in the color of the light, or a "red" light may be observed during the time delay. The time delay light goes out when the time difference expires. The driver's pit crew is not allowed to service the car until the time delay has expired. The benefit of this method is to eliminate the starting advantage of the cars at the front of the traditional starting grid. During the race the cars qualifying in the front of the grid will be moved backward in position on the race track by virtue of this delayed pit stop, and thereby have to pass their way to the front of the race. The order of lead cars is thus shuffled as they exit the pit road and re-enter the race. Fans would observe competitive passing among the leading race cars driving in close proximity to one another due to the re-shuffling of positions. Other time delays due to starting conditions may be added. For example, the delay imposed may occur after the car has been serviced. In that case, the car is serviced first, but cannot leave the pit stall until the light held by the official goes out, or changes color, or has some other discernible change. After the time delay expires, the car is allowed to leave the pit stall. After re-entering the race, the car would earn some form of credit for passing other cars. A car with a larger time delay would earn larger credit based on their QP.

Reference is now made to the diagram of a track shown in the sole figure. The track 10 is typically an oval or circle, although other track configurations may also be contemplated, such as a road course track with several reverse turns. On the track is the start/finish line 11 where the beginning of a race typically starts with all cars 13 typically in a two row alignment in closed position. The figure also shows the pit area 12 with a series of individual pit stalls 14 as is usual. An entry to the pit area is at 16 and an exit at 18. An official at 17 is associated with each pit stall 14 for controlling the exit of each car from its respective pit stall. For the slower cars there is preferably no delay, although in one embodiment all cars may be delayed but the faster cars are delayed more than the slower cars so that the faster cars are shuffled back from their leading positions.

In one example suppose there are thirty cars in a race and the last car passes the start/finish line 3 seconds after the lead car passes the start/finish line, then that difference is used as a basis for a delay, or the basis of delay, in the pit area for the fastest car or cars. One, or more than one fast car, may be subjected to the delay or an individual stepped delay may be used for each car. The end pack cars are subjected to the smallest delay or none at all. Thus, by way of example, if there are 30 race cars in the pack, on average, each car will be delayed from one to the next by 0.1 seconds. The lead car when arriving at the pits will have a full delay of 3 seconds and each of the other starting cars on the grid will be delayed by a stepped down amount such as, successively, 2.9; 2.8; 2.7; 2.6; etc. delay periods. Also, the delay time in the pits does not necessarily have to equate to the aforementioned starting delay periods but can be some type of modified function thereof. The manager of the track can have the authority to increase or decrease the pit delay depending upon other possible factors during the race.

In the system described herein where the fastest qualifying car is given the most favorable position at the beginning of the race, there may be a tendency for one or more of the race cars to develop a strategy so that they qualify more toward the middle of the grid so as to minimize their time delay at the service stop. This can be called a "hold back" strategy and is a valid race strategy. Most race promoters and managers and fans will want to discourage this strategy and to reward those who attempt to reach the highest QP. Under those circumstances, and in accordance with a method of the present invention, the pit delays may be further modified on the basis of the mid-pack cars relatively quickly passing a number of race cars in front of them in a relatively few laps. If this should occur, there is a strong likelihood that these middle pack cars held off during qualifying so that their qualifying speeds would arrange them more toward the middle of the pack, thus decreasing their pit delay time. Accordingly, detectors for the position of all cars can be monitored to determine if any one or more cars, such as those at the middle of the pack, pass a predetermined number of cars in a predetermined number of laps so as to trigger a modification to the pit delay time. This modification to the pit delay time would increase the delay period so that the mid-pack cars do not obtain an unfair advantage due to their intentional reduction themselves in qualifying speed. The manager of the track can determine what the predetermined number of cars and what the predetermined number of laps are used in order to trigger an increase in delay time at the pits. For example, if a mid-pack car, say the car with a starting position of 15, within five or six laps is up to $5^{th}$ place, this would automatically trigger an increase in the pit delay time so that that particular car is further delayed at its pit stop. This will make for a more equitable condition for racing. The increase in the delay period at the pits can be by a fixed amount of time or it can be a function of the number of cars that are passed within a set number of laps. Other methods of discouraging the hold back strategy can be developed to improve the quality of racing. These methods would reward cars with the highest QP and encourage competitive passing during a race. To accomplish this, these methods will give higher qualification credits and passing credits to those cars achieving high QP. Lesser credits will be given to cars with lower QP.

Second Embodiment

A qualification trial to determine the fastest cars is conducted and the order and speed of the cars is recorded. Before the race, the cars are arranged in a grid on the race track with the fastest car in the front row usually closest to the first turn, second fastest cars beside or behind the fastest car and so on to the least fastest cars at the end of the grid. The distance driven by each car is made identical by ending the race at the exact place where each car started the race.

The first two cars on the traditional starting grid would end at the traditional start/finish line but the other cars would end at their spot in the grid. The spot for each car could be determined by cameras or devices mounted in the track. Although very fair, this method is less preferred because it does not facilitate competitive passing as each car races to the start/finish line. In this regard see in the sole figure the marker line 20 representing placement of one of the cars. For that particular car the finish location would be at the same line 20. Another method of equalizing the distances driven is to make the cars at the front of the grid drive an additional distance so that they drive the same distance as the last car in the grid. This is geometrically opposite the first example in the second embodiment. This example also has the same practical issue of not facilitating competitive passing on the race track.

Third Embodiment

A qualification trial to determine the fastest cars is conducted and the order and speed of the cars is recorded. Before the race, the cars are arranged in a grid on the race track with the fastest car in the front row usually closest to the first turn, second fastest beside or behind the fastest car and so on to the least fastest car at the end of the grid. Engine characteristics (limited horsepower), weight (mandatory amount), tires and road contact and aerodynamic drag (car exterior) have been regulated for decades by each racing format. These are the main determinants of the speed of the race car. However, by developing a mathematical formula that links engine horsepower, weight and tire width (and other characteristics) to alter the balance between straight-line speed and cornering speeds, a new dimension is added to racing. Thus, a car with greater horsepower and speed would have tires with less cornering capabilities and a car with lesser horsepower would have tires with better cornering capabilities. The average speeds of both would be designed to be the same. This means the faster car on the straights would be slower in the turns. A driver would have to adjust the speed because of the position on the track and avoid other cars. Thus, the race would unfold different than the qualification trials. Each car may have different winning potential on different tracks because of the varying lengths of straight sections and the differences in curves. The formula is as follows or similar:

$HP \times K1 + WT \times K2 + TR \times K3 + DR \times K4 = K5$; set K5+1 and K1 through K4 are constants related to each speed characteristic.

Where:

HP=horsepower

WT=weight

TR=tire characteristics

DR=drag characteristics

Other mathematical formulas can be developed based on these variables and racing experience.

Fourth Embodiment

A qualification trial to determine the fastest cars is conducted and the order and speed of the cars is recorded. Before the race, the cars are arranged in a grid on the race track with the fastest car in the front row usually closest to the first turn, second fastest beside or behind the fastest car and so on to the least fastest car at the end of the grid. The drivers ability to handle different conditions would be challenged by reversing the direction of travel. In this case the driver and car would be required to adjust the speed to maneuver through each turn from a different direction. In this regard refer to the schematic diagram and the arrow A indicating the usual direction of travel and the reverse direction by arrow B. Reversing travel direction, after proper safety considerations, at some point in the race presents new challenges to the drivers, the car, and team operations as they cope with turning at high speeds in the opposite direction. Some drivers would be able to pass other competitors as they try to adjust to different conditions due to the different direction of travel. The race promoters would require that caution lights be illuminated and the safety car be used to re-form the race cars. The safety car would lead the race cars through the pits and then turn in the opposite direction on entering the track. After a few laps at the safety speed, the safety car exit the track. The race cars then increase their speed and at some time are allowed to resume the race.

Fifth Embodiment

A qualification trial to determine the fastest cars is conducted and the order and speed of the cars is recorded. Before the race, the cars are arranged in a grid on the race track with the fastest car in the front row usually closest to the first turn, second fastest beside or behind the fastest car and so on to the least fastest car at the end of the grid. Another method of altering the benefits given to the front cars in the traditional start is to change the road conditions during the race. This involves something as simple as spraying or dumping water on part, or all, of the course at some time in the race to simulate rain and thus challenging the drivers. Race track speeds and driving are highly dependent on track conditions and the tires. The race promoters would require that caution lights be illuminated and the safety car would be used to re-form the race cars. The safety car would lead the race cars while the water is being applied to the track. After several laps at the safety speed, the safety car would exit the track. The race cars would increase their speed and shortly thereafter be allowed to resume the race under the new conditions.

Each of the above different embodiments would counteract the unfair conditions of the traditional start and generate more competitive passing opportunities during the race. These embodiments would give race drivers the opportunity to demonstrate a greater ability to control the car over a wide range of racing conditions, not just the static case as is done now. These embodiments would give the fans greater excitement through more competitive passing.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A method of conducting a racing competition among a plurality of race cars which are driven on a race track, each race car being driven by a respective race car driver, said method comprising the steps of:

providing the race track in a form of a closed track, and upon which the plurality of race cars are driven;

providing a start/finish line on the race track;

providing a pit area disposed adjacent to the race track where the race cars are each periodically serviced and including individual pit stalls each for the service of a respective race car;

providing the pit area with an entry lane for the race cars for entry to the pit area from the track and an exit lane for the race cars for exit from the pit area to the track;

providing the individual pit stalls as a series of successive pit stalls arranged in a single linearly arranged row at the pit area;

conducting qualifying trials on the race track among the plurality of race cars so as to identify faster race cars and a slowest race car;

during the qualifying trials establishing a delay period, using timing equipment, for each faster race car based on a time difference, that is measured by the timing equipment, between when a respective faster race car passes over the start/finish line during the qualifying trial for the faster race car and the time that the slowest race car passes over the start/finish line during the qualifying trial for the slowest race car;

conducting a race on the race track among the plurality of race cars, the step of conducting the race including:

arranging the race cars in an initial order for the start of the race;

starting the race;

providing detectors to monitor a position of each race car during the race;

counting the number of race cars that each race car passes during a predetermined number of laps of the race, using the detectors, and increasing the delay period for each race car that passes a predetermined number of race cars during the predetermined number of laps;

the race cars periodically stopping for service at the pit area;

providing a plurality of separate signaling devices, a single one of the plurality of separate signaling devices being located at each respective pit stall in the pit area;

applying the delay period in the pit area so as to delay at least one of the faster cars in their exit from the pit area;

the step of applying the delay period including transferring the delay period of a faster race car to the signaling device associated with the pit stall of the faster car;

wherein each race car is serviced during a respective service period while at its pit stall;

wherein the delay period is applied as one of before and after the service period;

wherein the step of transferring the delay period includes providing the signaling device as a light display to inform each respective driver at the respective pit stall;

wherein the step of providing the signaling device as a light display includes operating the light display to provide a first observable illuminated state of the light display that has a duration that is equal to the duration of the delay period and during which time the respective race car cannot be serviced and, after the termination of the first observable illuminated state of the light display, operating the light display to provide a second observable illuminated state represented by a change in color of the observable illuminated state and during which time the respective race car is allowed to leave its pit stall;

determining a winner and order of race finish at a completion of the race based on the order of crossing the start/finish line.

2. The racing method of claim 1 wherein the pit area delay period follows a service period of the race car at the pit area.

3. The racing method of claim 1 wherein the pit area delay period precedes a service period of the race car at the pit area.

4. The racing method of claim 1 wherein the first illuminated state is "red".

5. The method of claim 1 wherein the increase in the delay period is a fixed amount.

6. The method of claim 1 wherein the increase in the delay period is a function of the number of race cars that are passed within the predetermined number of laps.

* * * * *